US008248398B2

(12) United States Patent
Cho et al.

(10) Patent No.: US 8,248,398 B2
(45) Date of Patent: Aug. 21, 2012

(54) DEVICE AND METHOD FOR DRIVING LIQUID CRYSTAL DISPLAY DEVICE

(75) Inventors: Nam Wook Cho, Gyeonggi-do (KR); Tae Woong Moon, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 643 days.

(21) Appl. No.: 12/314,642

(22) Filed: Dec. 15, 2008

(65) Prior Publication Data

US 2009/0278832 A1 Nov. 12, 2009

(30) Foreign Application Priority Data

May 9, 2008 (KR) ..... 10-2008-0043467

(51) Int. Cl.
*G09G 5/00* (2006.01)

(52) U.S. Cl. ..... 345/211; 345/87

(58) Field of Classification Search ..... 345/204, 345/211, 87–101
See application file for complete search history.

(56) References Cited

U.S. PATENT DOCUMENTS

| | | | | |
|---|---|---|---|---|
| 3,921,162 | A * | 11/1975 | Fukai et al. | 345/101 |
| 5,414,441 | A * | 5/1995 | Memarzadeh et al. | 345/87 |
| 6,097,240 | A * | 8/2000 | Lapushin | 327/513 |
| 7,071,929 | B2 * | 7/2006 | Fujii | 345/204 |
| 2006/0007207 | A1 * | 1/2006 | Kawaguchi | 345/204 |
| 2007/0012897 | A1 * | 1/2007 | Lee et al. | 252/299.1 |
| 2007/0085803 | A1 * | 4/2007 | Chu | 345/98 |
| 2007/0085806 | A1 * | 4/2007 | Moon | 345/98 |
| 2007/0252801 | A1 * | 11/2007 | Park et al. | 345/88 |

FOREIGN PATENT DOCUMENTS

| | | |
|---|---|---|
| CN | 1953036 | 4/2007 |
| CN | 101067920 | 11/2007 |
| JP | 2007-072270 | 3/2007 |

* cited by examiner

*Primary Examiner* — Amare Mengistu
*Assistant Examiner* — Hong Zhou
(74) *Attorney, Agent, or Firm* — Morgan, Lewis & Bockius LLP

(57) ABSTRACT

Device and method for driving a liquid crystal display device where a driving voltage level is varied with the temperature of an operating environment of the liquid crystal display device to improve display quality. The device includes a liquid crystal display panel, gate and data drivers for driving gate and data lines of the liquid crystal display panel, a timing controller for controlling the data and gate drivers, a power source unit for transforming an external power into a rated voltage level required for driving the liquid crystal display device and forwarding the power, and a driving voltage generating unit for adjusting a voltage level of the power transformed thus in conformity with an environmental temperature to generate a positive polarity driving voltage and using the driving, voltage for generating a plurality of driving voltages required for driving units, including the liquid crystal panel, the gate driver and data driver.

3 Claims, 3 Drawing Sheets

DEVICE AND METHOD FOR DRIVING LIQUID CRYSTAL DISPLAY DEVICE

This application claims the benefit of the Patent Korean Application No. 10-2008-0043467, filed on May 9, 2008, which is hereby incorporated by reference as if fully set forth herein.

BACKGROUND OF THE INVENTION

1. Field of the Invention

The present invention relates to liquid crystal display devices, and more particularly, to device and method for driving a liquid crystal display device: in which a level of a driving voltage is varied with variation of a temperature of an environment in which a liquid crystal display device is used for improving a quality of a picture displayed on the liquid crystal display device.

2. Discussion of the Related Art

In general, the liquid crystal display device controls a ratio of light transmission through liquid crystals by using an electric field for displaying a picture. To do this, the liquid crystal display device is provided with a liquid crystal display panel having a matrix of pixel regions, and a circuit for driving the liquid crystal display panel.

In general, the liquid crystal display device displays the picture by controlling the ratio of light transmission through the liquid crystals having dielectric anisotropy. To do this, the liquid crystal display device is provided with a liquid crystal display panel having a matrix of pixel regions, and a circuit for driving the liquid crystal display panel.

The liquid crystal display panel is provided with a plurality of gate lines and data lines arranged to cross each other, and the pixel regions at regions defined as the gate lines and data lines cross each other, respectively. The liquid crystal display panel is also provided with pixel electrodes and a common electrode for applying the electric field to the pixel regions. Each of the pixel electrodes is connected to a thin film transistor (TFT) which is a switching device. The TFT is turned on by a scan pulse from the gate line to charge a data signal from the data line to the pixel electrode.

The driving circuit is provided with a gate driver for driving the gate lines, a data driver for driving the data lines, a timing controller for supplying control signal for controlling the gate driver and the data driver, and a power source unit for supplying power to the liquid crystal display panel, the gate and data drivers, and the timing controller.

The gate driver has a shift register for forwarding the scan pulses in succession. The shift register has a plurality of stages connected in a cascade. Each of the plurality of stages has at least one of a plurality of the clock pulses having phase differences in succession applied thereto, and forwards the scan pulses in succession for scanning the gate lines in succession.

The liquid crystal display device has applications to various products, up to monitors, cellular phones, and personal terminals. According to this, because the liquid crystal display device can be used, not only within a fixed space, but also during in motion, and inside and outside of a building, it is required that the liquid crystal display device is designed to have resistance to an environmental temperature. For an example, permittivity of the liquid crystal filled in the liquid crystal display panel, resistance of the liquid crystal display panel itself, and the like vary sensitive to variation of the temperature. The variation of the permittivity of the liquid crystals and the resistances of the liquid crystal display panel can influence a driving range of the liquid crystals, and a change rate of a driving voltage level for driving the pixels in the liquid crystal display panel.

Because a waveform of a pixel voltage changes with reference to a common voltage if the level of the driving voltage applied to the pixels changes, even gradation of the picture displayed on a screen changes following change of a voltage difference between the pixel voltage and the common voltage. Therefore, since display of a picture of an accurate gradation is not possible, there has been a problem in that a quality of the picture becomes poor in overall, such as drop of a contrast ratio of the picture.

SUMMARY OF THE INVENTION

Accordingly, the present invention is directed to device and method for driving a liquid crystal display device.

An object of the present invention is to provide device and method for driving a liquid crystal display device, in which a level of a driving voltage varies with variation of a temperature an environment in which a liquid crystal display device is used.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a device for driving a liquid crystal display device includes a liquid crystal display panel having a plurality of pixel regions, gate and data drivers for driving gate and data lines of the liquid crystal display panel, a timing controller for controlling the data and gate drivers, a power source unit for transforming an external power into a rated voltage level required for driving the liquid crystal display device and forwarding the power, and a driving voltage generating unit for adjusting a voltage level of the power transformed thus in conformity with an environmental temperature to generate a positive polarity driving voltage and using the driving voltage for generating a plurality of driving voltages required for driving units, including the liquid crystal panel, the gate and data drivers.

The driving voltage generating unit includes a power IC for adjusting a voltage level of the power from the power source unit according to a feed back voltage received at a feedback terminal for generating and forwarding the positive polarity driving voltage, a feedback voltage adjusting unit for generating the feedback voltage having a level transformed in conformity with variation of the environmental temperature by using the positive polarity driving voltage from the power IC, and supplying the feedback voltage generated thus to the feedback terminal of the power IC, a Vcom generating unit for transforming the positive polarity driving voltage into a reference common voltage, a VGH generating unit for transforming the positive polarity driving voltage into a gate high voltage, and a VGL generating unit for transforming the positive polarity driving voltage into a gate low voltage.

The feedback voltage adjusting unit is connected to an output terminal of the positive polarity driving voltage of the power IC in parallel, and has the second resistor and the thermistor connected in parallel and arranged between the first resistor R1 and the third resistor R3 connected in series, so that a voltage divided between the first resistor and the thermistor connected in parallel and the third resistor connected in series is forwarded as the feedback voltage.

In another aspect of the present invention, a method for driving a liquid crystal display device includes the steps of transforming and forwarding external power received from an outside of the liquid crystal display device into a rated voltage level required for driving the liquid crystal display device, adjusting the voltage level of the power transformed thus in conformity with an environmental temperature for generating the positive driving voltage, and generating a plurality of driving voltages required for driving the liquid crystal display device including a liquid crystal display panel, gate and data drivers by using the positive polarity driving voltage.

The step of adjusting the voltage level of the power includes the step of adjusting the voltage level of the power transformed thus according to a feedback voltage received at the feedback terminal by using at least one power IC.

The step of generating a plurality of driving voltages includes the steps of generating the feedback voltage having a level transformed in conformity with the environmental temperature by using the positive polarity driving voltage, and supplying the feedback voltage to a feedback terminal of the power IC, transforming the positive polarity driving voltage into a reference common voltage, and forwarding the reference common voltage, transforming the positive polarity driving voltage into a gate high voltage, and forwarding the gate high voltage, and transforming the positive polarity driving voltage into a gate low voltage, and forwarding the gate low voltage.

The step of generating the feedback voltage includes the step of generating a voltage divided between a thermistor and a second resistor as the feedback voltage by using a feedback voltage adjusting unit connected to an output terminal of the positive polarity driving voltage of the power IC in parallel having a first resistor, the thermistor, the second resistor, and a ground terminal connected in succession in series.

The step of generating the feedback voltage includes the step of generating the voltage divided between the first resistor and the thermistor connected in parallel and a third resistor connected in series as the feedback voltage by using a feedback voltage adjusting unit connected to the output terminal of the positive polarity driving voltage of the power IC in parallel having the first resistor and the thermistor connected in parallel and arranged between the second resistor and a third resistor.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
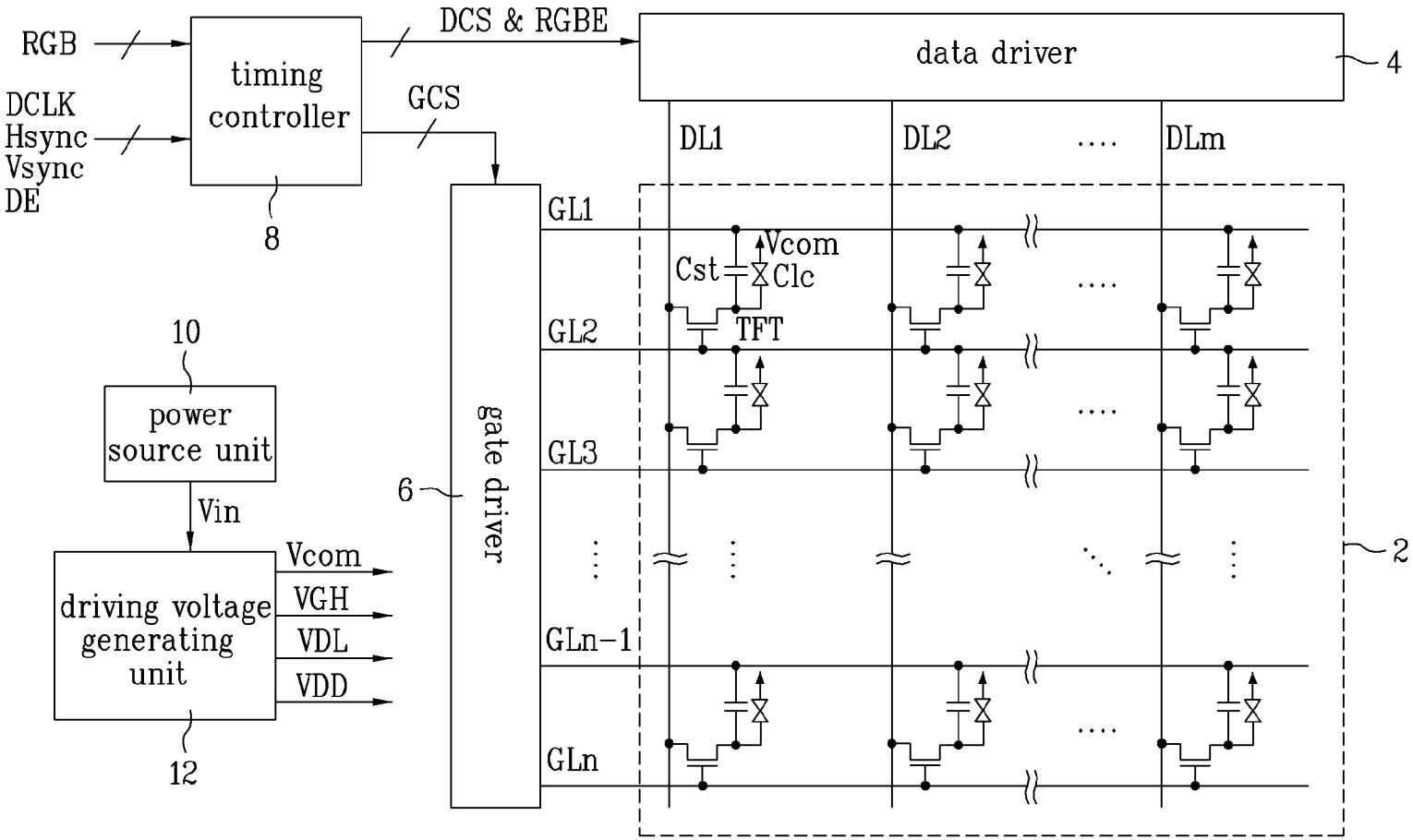
FIG. 1 is a block diagram illustrating a liquid crystal display device in accordance with a preferred embodiment of the present invention.

FIG. 1 is a block diagram illustrating a liquid crystal display device in accordance with a preferred embodiment of the present invention.

Referring to FIG. 1, the liquid crystal display device includes a liquid crystal display panel 2 having a plurality of pixel regions, a data driver 4 for driving data lines DL1~DLm on the liquid crystal display panel 2; a gate driver 6 for driving gate lines GL1~GLn on the liquid crystal display panel 2; a timing controller 8 for arranging picture data RGB from an outside of the liquid crystal display device suitable for driving the liquid crystal display panel 2 and supplying the picture data to the data driver 4, and generating data and gate control signals GCS and DCS for controlling the data and gate drivers 4 and 6, a power source unit 10 for transforming an external power into a rated voltage level required for driving the liquid crystal display device and forwarding the power, and a driving voltage generating unit 12 for adjusting a voltage level of the power Vin transformed thus in conformity with an environmental temperature to generate a positive polarity driving voltage VDD and using the driving voltage VDD for generating a plurality of driving voltages Vcom, VGH, and VGL.

The liquid crystal display panel 2 includes thin film transistors TFT formed at sub-pixel R, G, B, and ECB regions defined by the plurality of gate lines GL1~GLn and the plurality of data lines DL1~DLm, and a liquid crystal capacitor Clc connected to the TFT. The liquid crystal capacitor Clc has a pixel electrode connected to the TFT, and a common electrode facing the pixel electrode with the liquid crystal inbetween. The TFT supplies a picture signal from the data lines DL1~DLm to the pixel electrode in response to a scan pulse from the gate lines GL1~GLn. The liquid crystal capacitor Clc has a voltage charged therein, which is a difference between the picture signal supplied to the pixel electrode and a reference common voltage supplied to the common electrode, and varies an orientation of liquid crystal molecules with the difference of the voltage to control a light transmittivity for realizing the gradation. The liquid crystal capacitor Clc has a storage capacitor Cst connected thereto in parallel for making the picture signal charged therein to be sustained until the next picture signal is supplied. The storage capacitor Cst is overlapped with the pixel electrode with a prior gate line and an insulation film disposed inbetween or with a storage line and the insulation film disposed inbetween.

The data driver 4 converts the picture data RGBE from the timing controller 8 into an analog voltage, i.e., a picture signal by using a source start pulse SSP, a source shift clock SSC, and so on of data control signals DCS. In detail, the data driver 4 latches the picture data RGBE received in response to the source shift clock SSC of the data control signal DCS, and supplies a picture signal of one horizontal line portion to the data lines DL1~DLm in every one horizontal period in which the scan pulse is supplied to the gate lines GL1~GLn in response to the source enable SOE signal. In this instance, the data driver 4 selects a positive or negative polarity gamma voltage of a predetermined level according to a gradation value of he picture data RGBE received thus, and supplies the gamma voltage selected thus to the data lines DL1~DLm as the picture signal.

The gate driver 6 generates scan pulses in succession in response to gate control signals GCS from the timing controller 8, such as a gate start pulse and a gate shift clock GSC, controls pulse widths of the scan pulses in response to a gate output enable GOE signal, and supplies the scan pulses each having the pulse width controlled thus, i.e., gate one voltages to the gate lines GL1~GLn in succession. In detail, the gate driver 6 shifts the gate start pulse GSP from the timing controller 8 according to the gate shift clock GSC to generate the scan pulses in succession, controls the pulse widths of the scan pulses in response to the gate output enable GOE signal, and supplies the gate on voltages having the pulse widths controlled thus to the gate lines GL1~GLn in succession. In the meantime, in a period when no gate on voltage is supplied to the gate lines GL1~GLn, the gate driver 6 supplies gate off voltages.

The timing controller 8 arranges the picture data RGB from an outside of the liquid crystal display device suitable for driving of the liquid crystal display panel 2, and supplies the picture data RGB to the data driver 4. The timing controller 8 generates the gate control signal GCS and the data signal DCS by using synchronizing signals DCLK, DE, Hsync, and Vsync for controlling the data driver 4 and the gate driver 6.

The power source unit 10 has at least one transformer and an A/D converter for dropping/elevating a voltage of an external power to a level required for driving the liquid crystal display device, and supplies the power Vin having the voltage level transformed thus to the driving voltage generating unit 12, the gamma voltage generating unit (not shown), the data driver 4, and so on. Though not shown, by transforming the level of the external power to levels different from one another, the power source unit 10 also generates the gamma reference voltage, the negative polarity driving voltage, the analog driving voltage, and the like, and supplies to the gamma voltage generating unit, the gate and data driver 4 and 6, and the like.

The driving voltage generating unit 12 can adjust the voltage level of the power Vin having the voltage level transformed thus in conformity with an environmental temperature of the liquid crystal display device, again. In detail, the driving voltage generating unit 12 adjusts the voltage level of the power Vin in conformity with variation of the environmental temperature by using at least one power IC or DC/DC transformer, the voltage level adjusting unit, and the like for generating a positive polarity driving voltage VDD. The driving voltage generating unit 12 forwards a voltage adjusted thus, i.e., the positive polarity driving voltage VDD having the voltage level transformed in conformity with the variation of the environmental temperature, and generates a plurality of driving voltages Vcom, VGH, and VGL suitable for driving the liquid crystal display device by using the positive polarity driving voltage VDD.

The plurality of driving voltages generated at the driving voltage generating unit 12 can be the reference common voltage Vcom, the gate high voltage VGH used as the scan pulse or the gate on voltage, and the gate low voltage VGL used as the gate off voltage. The gate low voltage VGL and the gate high voltage VGH are supplied to the gate driver 6, and the reference common voltage Vcom is supplied to the liquid crystal display panel 2. The positive polarity driving voltage VDD is forwarded to the gamma voltage generating unit, the timing controller 8, the gate and data drivers 4 and 6, and so on. System and operation of the driving voltage generating unit 12 will be described in more detail.

Figure 2:
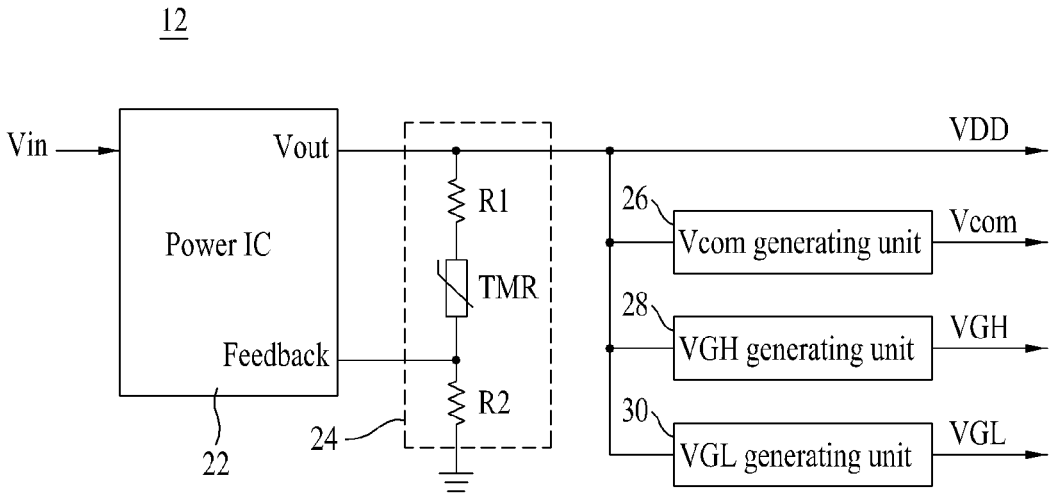
FIG. 2 is a block diagram illustrating the driving voltage generating unit in FIG. 1 in accordance with a preferred embodiment of the present invention.

FIG. 2 is a block diagram illustrating the driving voltage generating unit in FIG. 1 in accordance with a preferred embodiment of the present invention.

Referring to FIG. 2, the driving voltage generating unit 12 includes a power IC 22 for adjusting a voltage level of the power Vin from the power source unit 22 according to a feed back voltage received at a feedback terminal for generating and forwarding the positive polarity driving voltage VDD, a feedback voltage adjusting unit 24 for generating the feedback voltage having a level transformed in conformity with the variation of the environmental temperature by using the positive polarity driving voltage VDD from the power IC 22, and supplying the feedback voltage generated thus to the feedback terminal of the power IC 22, a Vcom generating unit 26 for transforming the positive polarity driving voltage VDD into the reference common voltage Vcom, and forwarding the reference common voltage Vcom, a VGH generating unit 28 for transforming the positive polarity driving voltage VDD into the gate high voltage VGH and forwarding the gate high voltage VGH transformed thus, and a VGL generating unit 30 for transforming the positive polarity driving voltage VDD into the gate low voltage VGL and forwarding the gate low voltage VGL transformed thus.

The power IC transforms the voltage level of the power Vin from the power source unit 22 to generate the positive polarity driving voltage VDD and forwards the same. In this instance, the power IC 22 drops/elevates a level of the positive polarity driving voltage VDD according to a level of the feedback voltage received at the feedback terminal. The power IC 22 can adjust the positive polarity driving voltage by dropping or elevating the level of the positive polarity driving voltage VDD proportional to or inversely proportional to a level of the feedback voltage. Hereinafter, on the assumption that resistance of metal is proportional to the environmental temperature, only a case will be described, in which the level of the positive polarity driving voltage VDD is adjusted so as to be inversely proportional to the level of the feedback voltage.

Since the feedback voltage adjusting unit 24 has at least one resistor R1 and R2, a thermistor TMR and a ground terminal connected to an output terminal Vout of the positive polarity driving voltage VDD of the power IC 22 in series, the feedback voltage adjusting unit 24 can forward a voltage divided between the first resistor R1 and the thermistor TMR and the second resistor R2 as the feedback voltage. In detail, the feedback voltage adjusting unit 24 is connected to the output terminal Vout of the positive polarity driving voltage VDD of the power IC 22 in parallel, with the first resistor R1, the thermistor TMR, the second resistor R2, and the ground terminal connected in succession in series, to forward the voltage divided between the thermistor TMR and the second resistor R2 as the feedback voltage. Capacities of the first to third resistors R1~R3 and the thermistor TMR may be set different from one another according to a rated voltage level of the liquid crystal display device or a level of the driving voltage VDD and levels of the driving voltages Vcom, VGH, and VGL.

A resistance of the thermistor TMR in the feedback voltage adjusting unit 24 is inversely proportional to temperature variation. Accordingly, the resistance becomes the lower as the environmental temperature becomes the higher, and vice versa. Due to this, if the environmental temperature rises to drop the resistance of the thermistor TMR, the level of the feedback voltage rises, and vice versa.

In this instance, the power IC 22 drops or raises the level of the positive polarity driving voltage VDD so as to be inversely proportional to the level of the feedback voltage received at the feedback terminal thereof for adjustment of the voltage. By this, the power IC 22 drops the voltage level of the power source Vin received therein as the environmental temperature becomes the higher to forward the positive polarity driving voltage VDD, and raises the voltage level of the power source Vin received therein as the environmental temperature becomes the lower to forward the positive polarity driving voltage VDD.

In the meantime, the Vcom generating unit 26 transforms the positive polarity driving voltage VDD having a voltage level adjusted according to a temperature to generate the reference common voltage Vcom, and supplies the reference common voltage Vcom to the common lines of the liquid crystal display panel 2.

The VGH generating unit 28 transforms the positive polarity driving voltage VDD having a voltage level adjusted according to a temperature to a gate high voltage VGH for turning on the TFT of the liquid crystal display panel 2, and supplies the gate high voltage VGH to the gate driver 6.

The VGL generating unit 30 transforms the positive polarity driving voltage VDD having a voltage level adjusted according to a temperature to a gate low voltage VGL for turning off the TFT of the liquid crystal display panel 2, and supplies the gate low voltage VGL to the gate driver 6.

As has been described, the device for driving the liquid crystal display device of the present invention, specifically, the driving voltage generating unit 12 drops the positive polarity driving voltage VDD as the environmental temperature becomes the higher in the adjustment of the voltage, and raises the positive polarity driving voltage VDD as the environmental temperature becomes the lower in the adjustment of the voltage. Owing to this, by maintaining the voltage levels of the driving voltages VDD, Vcom, VGH, and VGL constant even if the environmental temperature varies, the liquid crystal display device of the present invention can prevent a quality of an picture displayed thereon from becoming poor.

Figure 3:
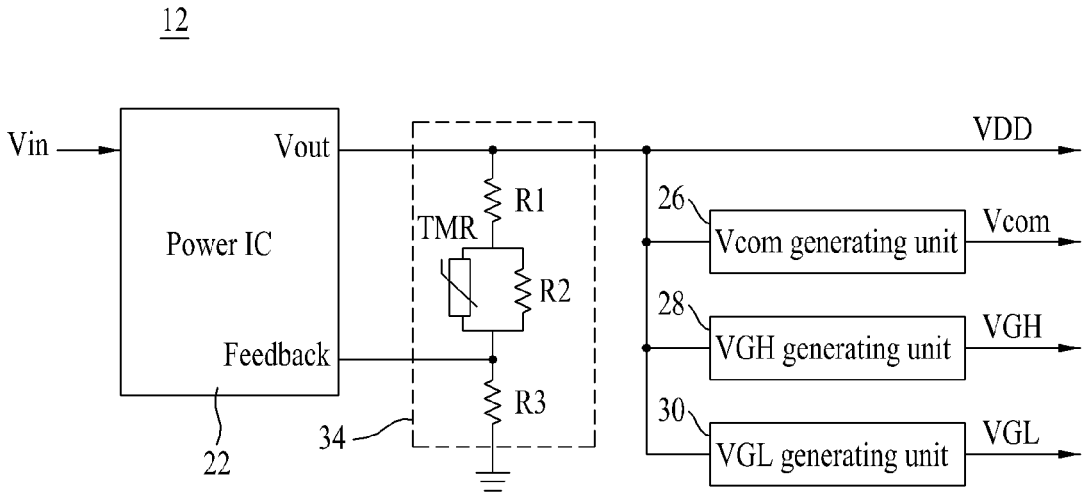
FIG. 3 is a block diagram illustrating the driving voltage generating unit in FIG. 1 in accordance with another preferred embodiment of the present invention.

FIG. 3 is a block diagram illustrating the driving voltage generating unit in FIG. 1 in accordance with another preferred embodiment of the present invention.

Referring to FIG. 3, the driving voltage generating unit 12 has a system and operation identical to the system and operation of the driving voltage generating unit shown in FIG. 2, except the feedback voltage adjusting unit 34. Therefore, detailed description of the driving voltage generating unit 12 which uses the same reference symbols will be omitted except description of the feedback voltage adjusting unit 34.

Referring to FIG. 3, the feedback voltage adjusting unit 34 includes at least one thermistor sensitive to a temperature for generating a feedback voltage in response to an environmental temperature variation. In this instance, the feedback voltage adjusting unit 34 generates the feedback voltage in conformity with the environmental temperature by using the positive polarity driving voltage VDD from the power IC 22, and supplies the feedback voltage generated thus to the power IC 22.

The feedback voltage adjusting unit 34 has at least one resistor R1~R3, a thermistor TMR, and a ground terminal connected to the output terminal Vout of the positive polarity driving voltage VDD of the power IC in series and parallel. In detail, the feedback voltage adjusting unit 34 is connected to the output terminal Vout of the positive polarity driving voltage VDD of the power IC in parallel, and has the second resistor R2 and the thermistor TMR connected in parallel and arranged between the first resistor R1 and the third resistor R3 connected in series, so that a voltage divided between the second resistor R2 and the thermistor TMR connected in parallel and the third resistor R3 connected in series is forwarded as the feedback voltage. Capacities of the first to third resistors R1~R3 and the thermistor TMR may be set different from one another according to a rated voltage level of the liquid crystal display device or a level of the positive polarity driving voltage VDD and levels of the driving voltages Vcom, VGH, and VGL.

A resistance of the thermistor TMR in the feedback voltage adjusting unit 34 is inversely proportional to temperature variation. Accordingly, the resistance becomes the lower as the environmental temperature becomes the higher, and vice versa. Due to this, if the environmental temperature rises to drop the resistance of the thermistor TMR, the level of the feedback voltage rises, and vice versa. The second resistor R2 connected in parallel to the thermistor TMR is provided for reducing a width of variation of the resistance of the thermistor TMR. That is, though the resistance of the thermistor TMR varies with the capacity thereof, the resistance can vary infinitely inversely proportional to the variation of the environmental temperature. Therefore, the second resistor R2 is used for reducing the width of variation of the resistance of the thermistor TMR.

In the meantime, the power IC 22 drops or raises the level of the positive polarity driving voltage VDD so as to be inversely proportional to the level of the feedback voltage received at the feedback terminal thereof for adjustment of the voltage. By this, the power IC 22 drops the voltage level of the power source Vin received therein as the environmental temperature becomes the higher to forward the positive polarity driving voltage VDD, and raises the voltage level of the power source Vin received therein as the environmental temperature becomes the lower to forward the positive polarity driving voltage VDD.

The feedback voltage adjusting unit 34 may be mounted to an inside or outside of the power IC 22, and may be mounted to an output terminal of the Vcom generating unit 26, the VGH generating unit 28, or the VGL generating unit 30 for adjusting the reference common voltage Vcom, the gate high voltage VGH, and the gate low voltage VGL, respectively.

Figure 4:
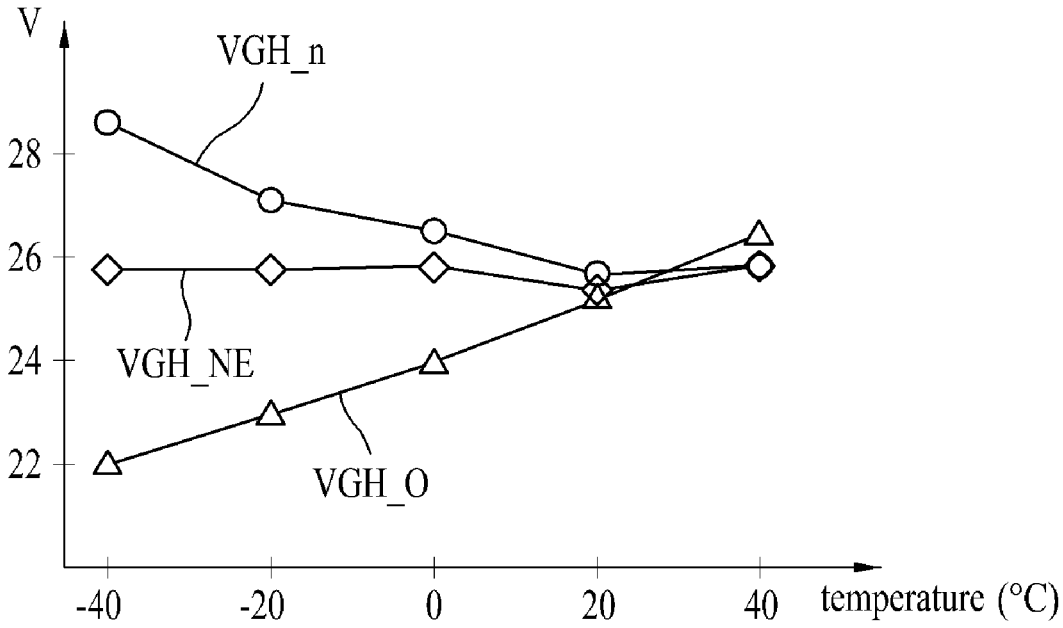
FIG. 4 is a graph showing temperature variation versus gate high voltage level following use of the feed back voltage adjusting unit in FIG. 2 or 3.

FIG. 4 is a graph showing temperature variation versus gate high voltage level following use of the feed back voltage adjusting unit in FIG. 2 or 3.

Referring to FIG. 4, in a case of a related art gate high voltage VGH_0, as a voltage level of the gate high voltage VGH_0 becomes the lower as the environmental temperature becomes the lower, and vice versa, the voltage level is proportional to the environmental temperature. That is, it can be known that the driving voltages Vcom, VGL, and VDD inclusive the gate high voltage VGH vary with the environmental temperature.

Opposite to this, in a case of the gate high voltage VGH_n when the feedback voltage adjusting unit 24 is used, though a fixed voltage level is maintained regardless of the environmental temperature within a temperature range of −20° C.~20° C., a width of the voltage level becomes greater at a low temperature below −30° C. or a high temperature over 30° C. That is, it can be known that, if the feedback voltage adjusting unit 24 shown in FIG. 2 is used, the driving voltages Vcom, VGL, and VDD inclusive the gate high voltage VGH are influenced from the environmental temperature variation at the low temperature below −30° C. or the high temperature over 30° C.

Along with this, in a case of the gate high voltage VGH_NE when the feedback voltage adjusting unit 34 is used, though a fixed voltage level is maintained even at a low temperature below −40° C. or a high temperature over 40° C. That is, it can be known that, if the feedback voltage adjusting unit 34 shown in FIG. 3 is used, the driving voltages Vcom, VGL, and VDD inclusive the gate high voltage VGH can be maintained constant regardless of the environmental temperature.

As has been described, the device for driving a liquid crystal display device of the present invention, specifically the driving voltage generating unit 12 drops the positive polarity driving voltage VDD as the environmental temperature becomes the higher for adjusting the driving voltage, and vice versa. Owing to this, the liquid crystal display device of the present invention can maintain levels of the driving voltages VDD, Vcom, VGH, and VGL constant, thereby preventing a quality of the picture displayed on the liquid crystal display device from becoming poor.

As has been described, the device and method for driving a liquid crystal display device of the present invention has the following advantages.

The level of the driving voltage can be varied with a temperature of an environment in which the liquid crystal display device is used, thereby improving a quality of a picture displayed on the liquid crystal display device.

That is, the device for driving a liquid crystal display device drops the positive polarity driving voltage the more as the environmental temperature becomes the high and vice versa for adjusting the positive polarity driving voltage. Owing to this, levels of the driving voltages VDD, Vcom, VGH, and VGL are maintained constant even if the environmental temperature varies, thereby preventing a quality of a picture displayed on the liquid crystal display device from becoming poor.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A device for driving a liquid crystal display device comprising:

a liquid crystal display panel having a plurality of pixel regions;

gate and data drivers for driving gate and data lines of the liquid crystal display panel;

a timing controller for controlling the data and gate drivers;

a power source unit for transforming an external power into a rated voltage level required for driving the liquid crystal display device and forwarding the power; and a driving voltage generating unit for adjusting a voltage level of the power transformed thus in conformity with an environmental temperature to generate a positive driving voltage and using the driving voltage for generating a plurality of driving voltages required for driving units, including the liquid crystal panel, the gate and data drivers, wherein the driving voltage generating unit includes a power IC for adjusting a voltage level of the power from the power source unit according to a feed back voltage received at a feedback terminal for generating and forwarding the positive driving voltage, a feedback voltage adjusting unit for generating the feedback voltage having a level transformed in conformity with variation of the environmental temperature by using the positive driving voltage from the power IC, and supplying the feedback voltage generated thus to the feedback terminal of the power IC, wherein the feedback voltage adjusting unit is connected to the output terminal of the positive polarity driving voltage of the power IC in parallel, and has a first resistor and a thermistor connected in parallel and arranged between a second resistor and the third resistor connected in series, and a voltage divided between the first resistor and the thermistor connected in parallel and the third resistor connected in series is forwarded as the feedback voltage, wherein the first resistor connected in parallel to the thermistor is reducing a width of variation of the resistance of the thermistor, wherein the capacities of the first to third resistor and the thermistor set different from one another according to a rated voltage level of the liquid crystal display device or a level of the driving voltage and levels of the driving voltages.

2. The device as claimed in claim 1, wherein the driving voltage generating unit includes;

a Vcom generating unit for transforming the positive polarity driving voltage into a reference common voltage, a VGH generating unit for transforming the positive driving voltage into a gate high voltage, and a VGL generating unit for transforming the positive driving voltage into a gate low voltage.

3. A method for driving a liquid crystal display device comprising the steps of:

transforming and forwarding external power received from an outside of the liquid crystal display device into a rated voltage level required for driving the liquid crystal display device;

adjusting the voltage level of the power transformed thus in conformity with an environmental temperature for generating the positive driving voltage; and generating a plurality of driving voltages required for driving the liquid crystal display device including a liquid crystal display panel, gate and data drivers by using the positive driving voltage, wherein the step of adjusting the voltage level of the power includes the step of adjusting the voltage level of the power transformed thus according to a feedback voltage received at a feedback terminal by using at least one power IC, and generating the feedback voltage having a level transformed in conformity with the environmental temperature by using the positive driving voltage, and supplying the feedback voltage to the feedback terminal of the power IC, wherein the step of generating the feedback voltage includes the step of generating the voltage divided between the first resistor and the thermistor connected in parallel and a third resistor connected in series as the feedback voltage by using a feedback voltage adjusting unit connected to the output terminal of the positive polarity driving voltage of the power IC in parallel having the first resistor and the thermistor connected in parallel and arranged between the second resistor and a third resistor, wherein the first resistor connected in parallel to the thermistor is reducing a width of variation of the resistance of the thermistor, wherein the capacities of the first to third resistor and the thermistor set different from one another according to a rated voltage level of the liquid crystal display device or a level of the driving voltage and levels of the driving voltages.

* * * * *